US006635856B2

(12) United States Patent
Fishman

(10) Patent No.: US 6,635,856 B2
(45) Date of Patent: Oct. 21, 2003

(54) BILLET INDUCTION HEATING

(75) Inventor: Oleg S. Fishman, Maple Glen, PA (US)

(73) Assignee: Inductotherm Corp., Rancocas, NJ (US)

( * ) Notice: Subject to any disclaimer, the term of this patent is extended or adjusted under 35 U.S.C. 154(b) by 0 days.

(21) Appl. No.: 10/346,413

(22) Filed: Jan. 17, 2003

(65) Prior Publication Data

US 2003/0136778 A1 Jul. 24, 2003

Related U.S. Application Data

(60) Provisional application No. 60/349,612, filed on Jan. 18, 2002.

(51) Int. Cl.[7] ..... H05B 6/06; H05B 6/14; H05B 6/44

(52) U.S. Cl. ..... 219/637; 219/646; 219/656; 219/662; 219/674; 266/129; 148/567; 148/572

(58) Field of Search ..... 219/637, 646, 219/656, 662, 674, 635, 643, 655, 671, 672; 266/129; 148/567, 570, 572

(56) References Cited

U.S. PATENT DOCUMENTS

| | | | | |
|---|---|---|---|---|
| 3,535,485 A | * | 10/1970 | Soworowski | 219/654 |
| 3,657,506 A | * | 4/1972 | Aronson | 219/671 |
| 4,307,278 A | * | 12/1981 | Lewis | 219/662 |
| 5,448,039 A | * | 9/1995 | Okayama et al. | 219/646 |

* cited by examiner

*Primary Examiner*—Philip H. Leung
(74) *Attorney, Agent, or Firm*—Philip O. Post

(57) ABSTRACT

A plurality of billets are inductively heated in a staged process wherein the output current of a power supply is repeatedly time shared among a plurality of induction coils within which the plurality of billets have been placed. The time periods of the applied current to each coil become sequentially shorter over the total heating time of a billet to allow magnetically induced heat to conduct to the center of the billet during the dwell periods between applied electrical current periods. This maximizes the efficiency of the output of the power supply while melting of the outer regions of a billet is avoided in a process wherein the billets do not have to be moved during the overall billet total heating time.

20 Claims, 5 Drawing Sheets

APPLIED POWER SCHEDULE FOR COIL 1 (BILLET 11)

APPLIED POWER SCHEDULE FOR COIL 2 (BILLET 12)

APPLIED POWER SCHEDULE FOR COIL 3 (BILLET 13)

APPLIED POWER SCHEDULE FOR COIL 4 (BILLET 14)

APPLIED POWER SCHEDULE FOR COIL 5 (BILLET 15)

BILLET INDUCTION HEATING

CROSS REFERENCE TO RELATED APPLICATIONS

This application claims the benefit of U.S. Provisional Application No. 60/349,612, filed Jan. 18, 2002.

FIELD OF THE INVENTION

The present invention relates generally to induction heating of billets, and in particular, to simultaneous induction heating of multiple billets in a sequenced process.

BACKGROUND OF THE INVENTION

A heated metal billet can be worked into a manufactured article by, for example, forging or die casting the heated billet. Ideally the billet is heated throughout its cross section to a substantially uniform temperature that is slightly below the melting point of the billet material for maximum workability of the billet. Uniformity of temperature throughout the billet material avoids the formation of isolated solid or molten regions within the billet that can result in deformities of the worked article. One method of heating and melting an electrically conductive billet, such as an aluminum billet, is by electric induction heating. In this method, a magnetic field generated by the flow of ac current in a coil placed around the axial length of the billet will heat the billet by magnetically coupling the field with the billet. The resulting magnetic field penetrates the billet and produces an eddy current in the billet, which heats the billet material. Some electrically conductive materials, such as aluminum based compositions, exhibit a relatively small degree of field penetration into the material. FIG. 1 illustrates the typical drop off in the effectiveness of heating a billet 11 by magnetic induction from field 90, which is shown diagrammatically as sample flux (dashed oval) lines for a field produced by an induction coil surrounding the axial length of billet 11. As illustrated by curve $I_{ind}$ in the $I_m$ versus $r_m$ graph in FIG. 1, the depth (or magnitude) of the induced eddy current, $I_m$, in a billet having a radius, $r_m$, rapidly decreases towards the axial center of the billet. Consequently effective induced eddy current (dashed horizontal lines in FIG. 1) heating of the billet is concentrated in the outer annular region of the billet, $\Delta_m$, which is defined as the magnetically induced eddy current depth of penetration. Attempting to rapidly heat an aluminum billet throughout its entire thickness by induction to a generally uniform temperature will result in melting the outer annular region of the billet material before the required level of heat is reached at the center of the billet. Consequently the applied level of induced billet heating power must be limited. This can be accomplished either by maintaining a relatively low and constant induced heat energy (power multiplied by the applied time period) during the entire heating cycle for a billet, or by initially applying a high level of induced heat energy, followed by decreasing levels of induced heat energy over the entire heating cycle for a billet. As the outer volume of the billet is inductively heated, heat conducts into the center of the billet material. The process is particularly effective with a billet metal composition, such as an aluminum or magnesium based composition, which has a relatively high value of thermal conductivity. This process is sometimes described as heat "soaking" the billet, since the magnetically induced heat "soaks" to the interior of the billet by conduction of heat through the billet material.

Early prior art billet induction heating is disclosed in U.S. Pat. No. 3,535,485 (the 485 patent), titled Induction Heating Device for Heating a Succession of Elongated Workpieces. The 485 patent teaches sequential pushing of billets into two or more separate induction coils for heating so that heated billet production can be increased by sequencing an automated billet feeding mechanism 12 with the two or more separate induction coils. In this fashion, a billet in each of the two or more separate induction coils is heated to a different degree at any instant of time. The billet feeding mechanism 12 indexes to an induction coil with a fully heated billet and ejects the fully heated billet by pushing a non-heated billet into the induction coil. The 485 patent does not teach varying the induced heat energy, or staging induced heat energy sequentially among the two or more separate induction coils.

U.S. Pat. No. 4,307,278, titled Control Device for Parallel Induction Heating Coils teaches the use of a plurality of induction coils that are connected in parallel to a single power source. An elongated workpiece is heated in each of the coils. Induced heat energy in each workpiece is varied by mechanically adjusting the length of the coil based upon feedback from a temperature sensor so that uniform heating of the workpiece can be achieved.

Another known method of heating a billet is the use a carousel system in which a billet is sequentially transferred among induction heating coils. The coils are of varying configurations so that they induce progressively lower levels of energy to a billet as it is sequenced in the carousel system. The system can be used to simultaneously heat as many billets as there are induction coils in a sequenced process. For example in a vertically aligned carousel system, multiple vertically aligned and radially spaced billets sit on a carousel. A multiple coil assembly consisting of a sequence of induction coils arranged for inductive energy transfer is disposed above the billets. The multiple coil assembly can be lowered so that each coil surrounds a billet and transfers varying levels of inductive energy to the billets on the carousel. After a selected period of time, the multiple coil assembly is raised and the carousel with billets is indexed so that each billet moves to the next lower inductive energy coil. The fully heated billet that was last surrounded by the lowest inductive energy coil in the assembly is removed from the carousel and a non-heated billet is put in its place on the carousel to be surrounded by the highest inductive energy coil in the assembly to propagate the billet heating process. This method is disadvantageous in that the billets are vertically oriented and the outer volume of the billets, having been subjected to all of the induced heat energy, tend to sag by completion of the heating process for a billet. This method also requires moving the billets during the indexing process.

Therefore there is the need for apparatus and method of inductively heating a billet that minimizes deformation and handling of a billet during the heating process to a substantially uniform temperature that may be close to the melting temperature of the billet material.

BRIEF SUMMARY OF THE INVENTION

In one aspect, the present invention is an apparatus for and method of inductively heating a plurality of billets. Each billet is surrounded by an induction coil. All of the induction coils can be connected to a single ac power supply in a circuit having an individual power switch between the supply and each coil. Output of the power supply can be kept at a constant level while the output is sequentially switched among each of the induction coils. Switched power scheduling to each coil is such that the power supply provides inductive power over progressively shorter time intervals, and hence, a progressively smaller amount of heating energy to each coil in the sequence during an applied power cycle. The current in each coil creates a magnetic field that couples with the billet in the coil and inductively heats the billet. During the power dwell time between the repetitive applications of power to a coil by the power switch, the induced heat conducts into the interior of the billet. With appropriate switched power scheduling among all the coils, billets are sequentially fully heated at the end of a billet heating cycle.

In another aspect, the present invention is an apparatus for and method of sequentially induction heating a plurality of billets. Each billet is inserted into a separate induction coil so that the axial length of the billet is substantially surrounded by the induction coil. At least one ac power supply is used to provide ac current sequentially to each of the induction coils for a variable time period in multiple power cycles. The power supply may optionally operate at a substantially constant magnitude of output power. The total number of power cycles is equal to the total number of induction coils. The variable time period during which ac current is supplied to an induction coil is progressively shorter in each power cycle. Each induction coil receives ac current for the same set of variable time periods over all of the power cycles, but in any particular power cycle, each induction coil receives ac current for different variable time periods. The ac current supplied to each induction coil is inductively coupled with the billet inserted in the coil, which inductively heats the billet. A billet is completely heated after it has been subjected to sequential induction heating for the total number of power cycles. The apparatus may optionally include a means for inserting a billet into an induction coil at the beginning of the power cycle wherein the induction coil is connected to the at least one ac power supply for the longest variable time period. Further the apparatus may optionally include a means for removing a billet from an induction coil after the completion of the total number of power cycles for the coil. Optionally a processor may be provided for sensing the surface temperature of each of the billets while it is being induction heated, and responsive to the sensing, the magnitude of the output power from the ac power supply or the time of the variable time periods may be adjusted to complete the induction heating of the billets.

Other aspects of the invention are set forth in this specification.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
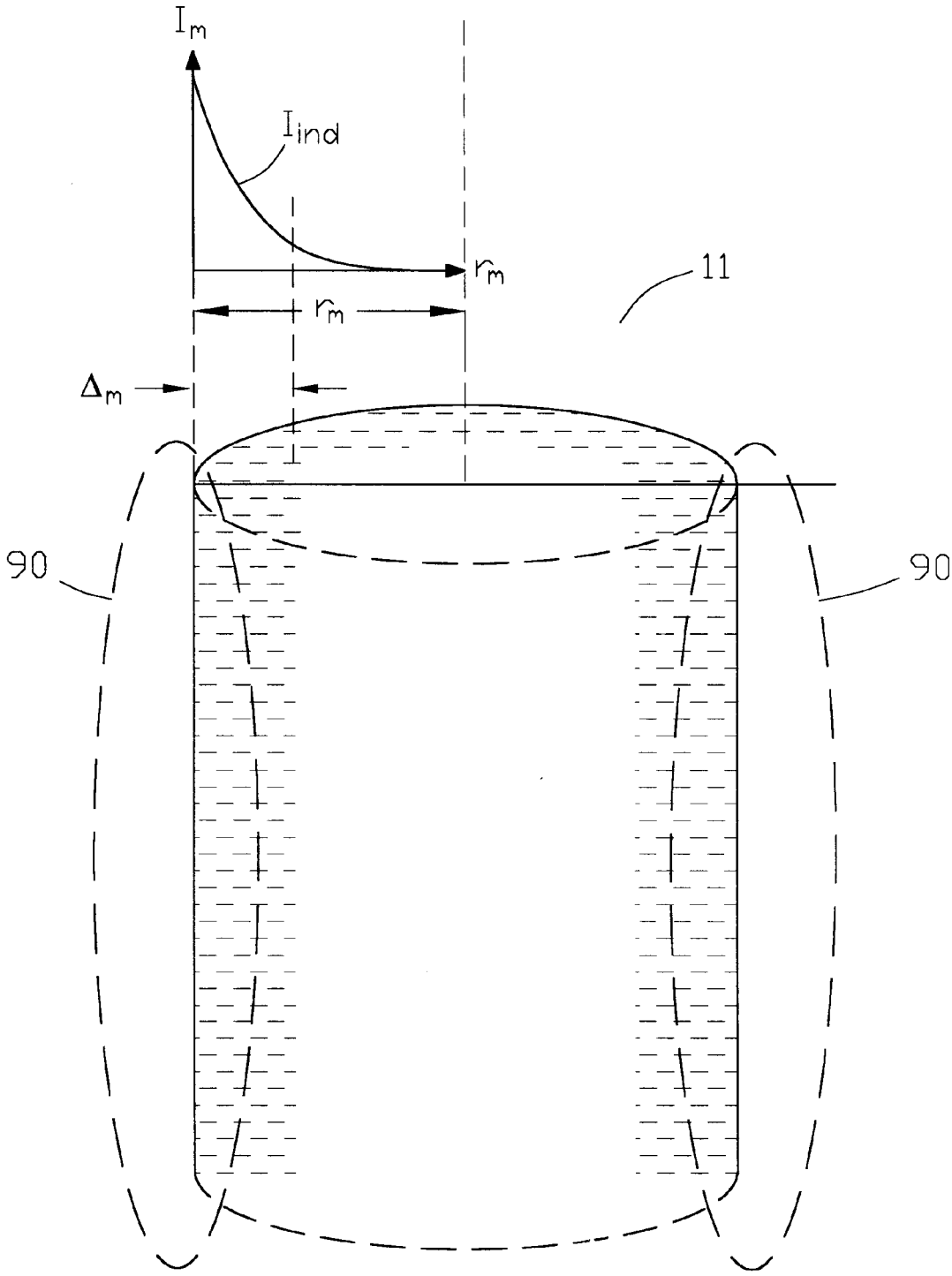
FIG. 1 illustrates the effective depth of eddy current penetration into a typical billet from inductively coupling the billet with a magnetic field.
Figure 2:
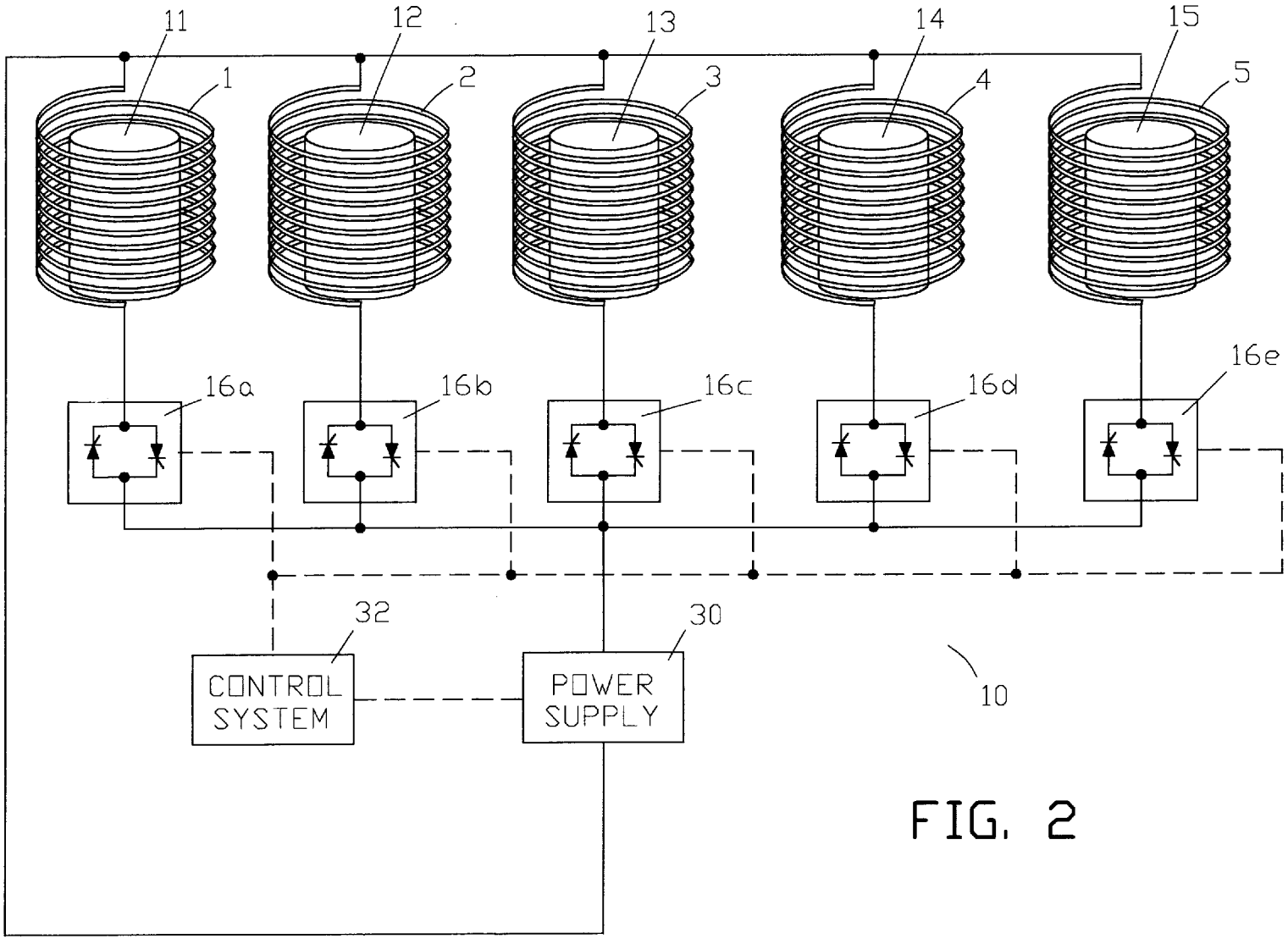
FIG. 2 diagrammatically illustrates one arrangement of the induction billet heating apparatus of the present invention.

Referring now to the drawings, wherein like numerals indicate like elements there is shown in FIG. 2 one example of the billet induction heating apparatus 10 of the present invention. Each billet 11, 12, 13, 14 and 15 is placed within an induction coil 1, 2, 3, 4 and 5, respectively, so that the coil substantially surrounds the axial length of the billet, to inductively couple each billet to a magnetic field that is generated when current is sequentially supplied from ac power supply 30, operating at a suitable frequency, through power switches 16*a*, 16*b*, 16*c*, 16*d* and 16*e*, respectively. Power supply 30 may be a single supply or a plurality of power supplies suitably connected together. Generally all billets and all coils are of similar configurations. In some examples of the invention, each coil may be specially configured to accept a billet that differs in configuration from the other billets. While the billets are shown diagrammatically as cylindrical in shape, and the billet material is described as an aluminum or magnesium based composition, these are not limiting features of the invention. The billet may be of other shapes, and the billet material may be any electrically conductive material. In this example, five coils and billets are used. However, the plurality of billets and associated coils is exemplary and does not limit the scope of the invention. That is, the number of billets and coils can be generalized as an integer number, n.

Figure 3:
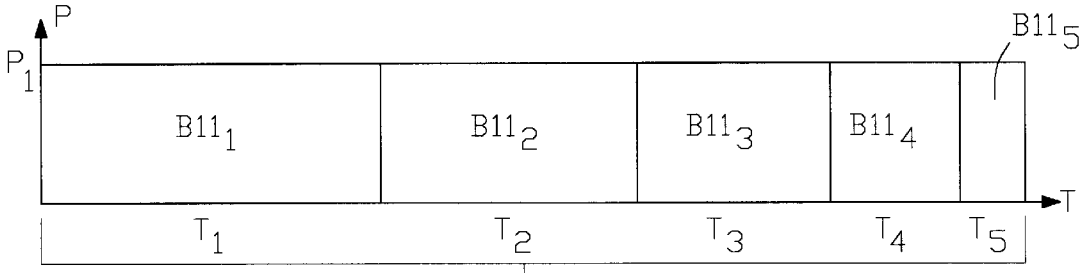
FIG. 3 diagrammatically illustrates switched power scheduling for variable time periods among multiple coils in one example of the induction billet heating apparatus of the present invention.
Figure 3:
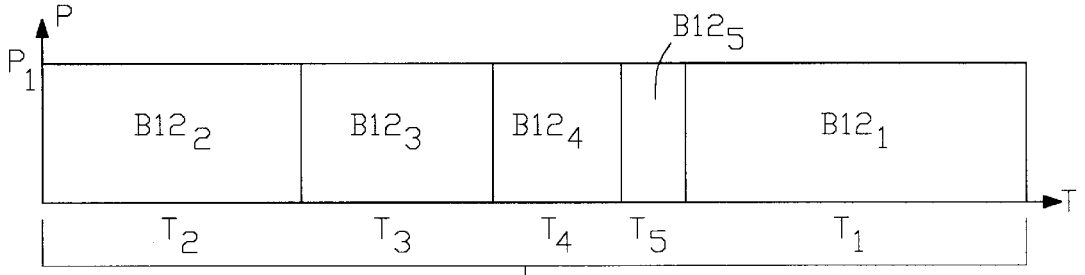
Figure 3:
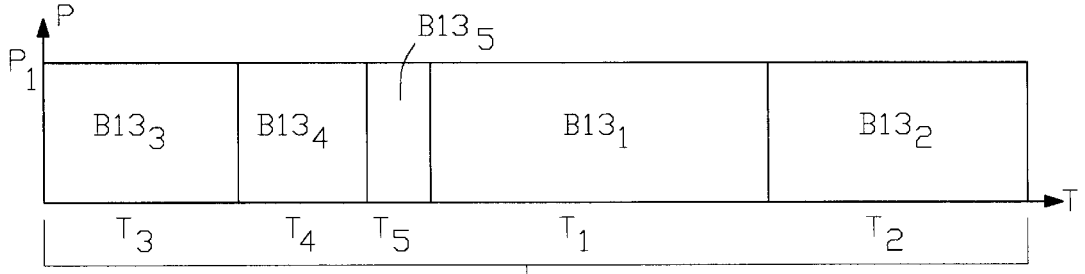
Figure 3:
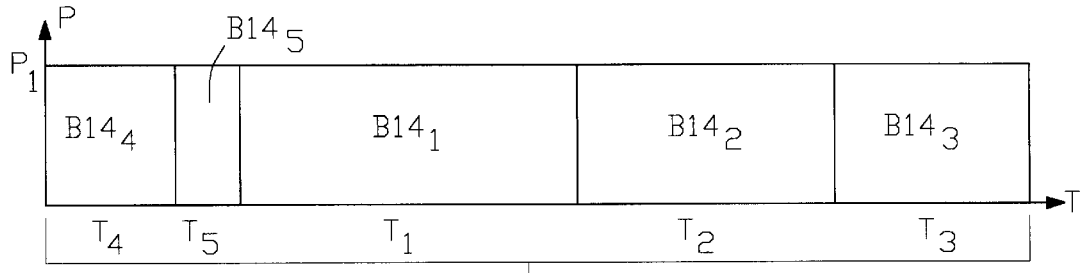
Figure 3:
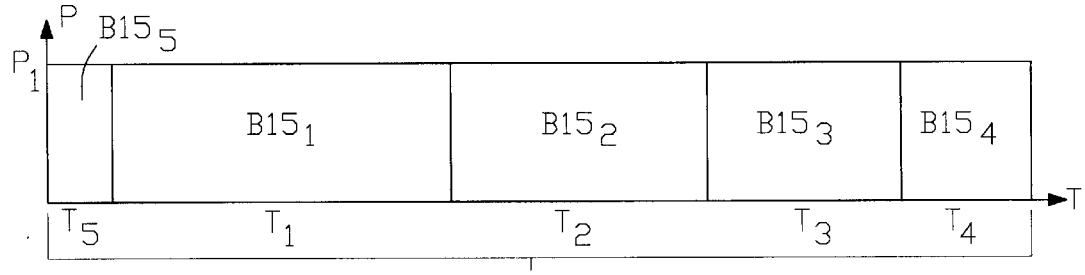

While the means for individually connecting each one of the plurality of induction coils to the power supply in FIG. 2, namely power switches 16*a* through 16*e*, are shown symbolically as silicon controlled rectifiers (SCRs), any other type of power switches suitably configured for a particular application can be used. Each power switch is sequentially closed for a predetermined amount of time to supply ac current to each of the induction coils in sequence. FIG. 3 illustrates one example of an applied power schedule (power, P, versus time, T) to each coil for sequentially heating the five billets shown in FIG. 2. Total time of applied power (or current) to each coil during each applied power cycle is divided up into five decreasing time segments $T_1$, $T_2$, $T_3$, $T_4$, and $T_5$ (listed in decreasing time order). In this non-limiting example, the magnitude of the output of power supply 30 is at constant value $P_1$. Each induction coil is connected to the output of the power supply for the same series of variable time periods. That is, as illustrated in FIG. 3, energy (power multiplied by time) blocks $\mathbf{B11}_1$, $\mathbf{B12}_1$, $\mathbf{B13}_1$, $\mathbf{B14}_1$, and $\mathbf{B15}_1$ are all equal to each other; energy blocks $\mathbf{B11}_2$, $\mathbf{B12}_2$, $\mathbf{B13}_2$, $\mathbf{B14}_2$, and $\mathbf{B15}_2$ are all equal to each other; energy blocks $\mathbf{B11}_3$, $\mathbf{B12}_3$, $\mathbf{B13}_3$, $\mathbf{B14}_3$, and $\mathbf{B15}_3$ are all equal to each other; energy blocks $\mathbf{B11}_4$, $\mathbf{B12}_4$, $\mathbf{B13}_4$, $\mathbf{B14}_4$, and $\mathbf{B15}_4$ are all equal to each other; and energy blocks $\mathbf{B11}_5$, $\mathbf{B12}_5$, $\mathbf{B13}_5$, $\mathbf{B14}_5$, and $\mathbf{B15}_5$ are all equal to each other. However, since each coil is sequentially connected to the output of the power supply in each power cycle ($T_{cycle1}$ through $T_{cycle5}$ in FIG. 4), the variable time period for which each induction coil is connected to the output of the power supply is different in each power cycle. For example, in FIG. 4, the sequence for connecting the power supply to each coil: in power cycle is $T_{cycle1}$ $\mathbf{B11}_1$, $\mathbf{B12}_2$, $\mathbf{B13}_3$, $\mathbf{B14}_4$, $\mathbf{B15}_5$; in power cycle $T_{cycle2}$ is $\mathbf{B11}_2$, $\mathbf{B12}_3$, $\mathbf{B13}_4$, $\mathbf{B14}_5$, $\mathbf{B15}_1$; in power cycle $T_{cycle3}$ is $\mathbf{B11}_3$, $\mathbf{B12}_4$, $\mathbf{B13}_5$, $\mathbf{B14}_1$, $\mathbf{B15}_2$; in power cycle $T_{cycle4}$ is $\mathbf{B11}_4$, $\mathbf{B12}_5$, $\mathbf{B13}_1$, $\mathbf{B14}_2$, $\mathbf{B15}_3$; and in power cycle $T_{cycle5}$ is $\mathbf{B11}_5$, $\mathbf{B12}_{B143}$, $\mathbf{B15}_4$.

Figure 4:
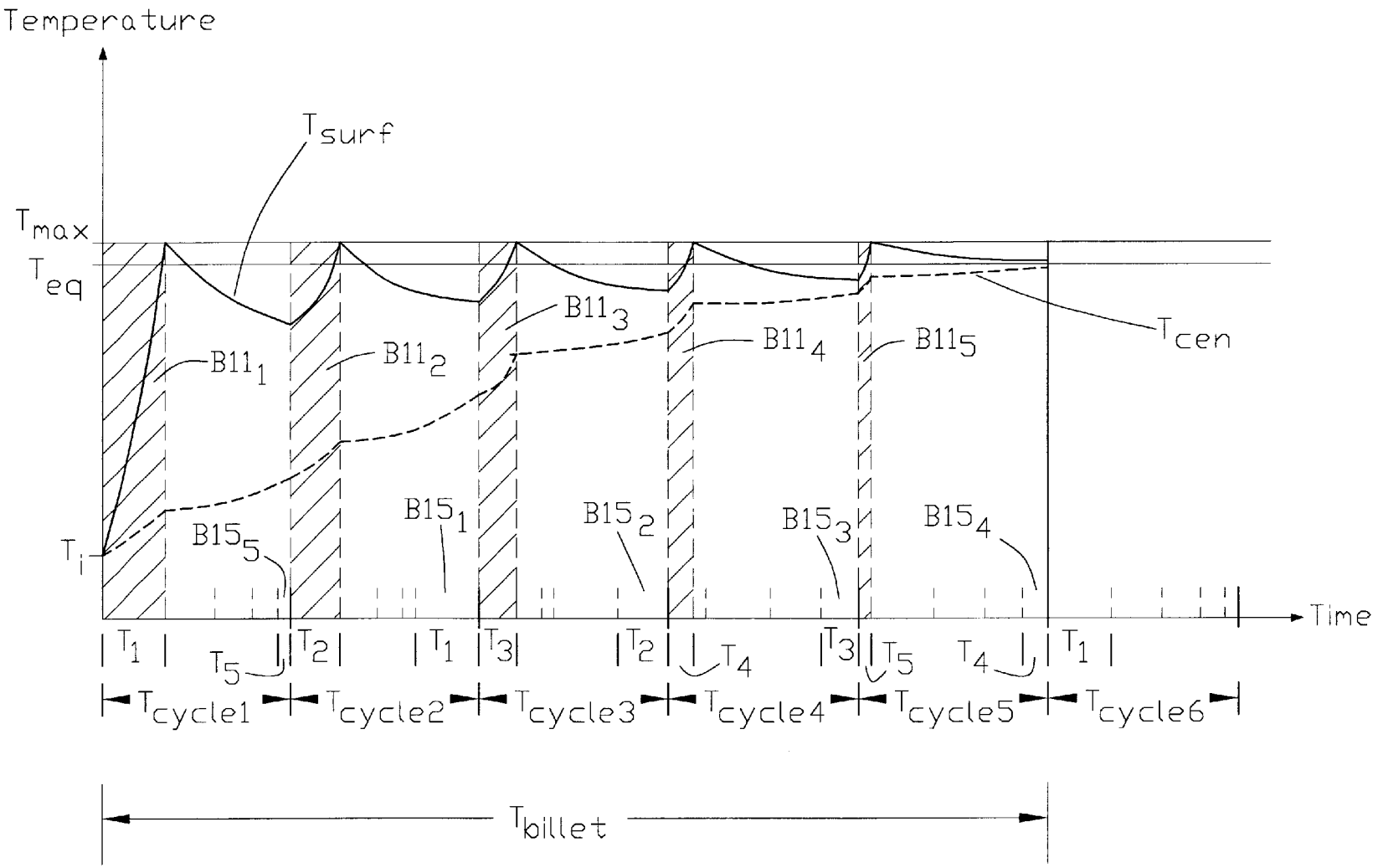
FIG. 4 graphically illustrates the heating of a billet over a total billet heating cycle for one example of the induction billet heating apparatus of the present invention.

FIG. 4 illustrates the heating process to fully heat billet 11 within coil 1. Billet 11 is placed within coil 1 at an initial temperature $T_i$, which typically is, but not limited to room temperature. During the first power cycle, $T_{cycle}$, current is supplied to coil 1 from power supply 30 through conducting power switch 16*a* for time period $T_1$ (shown crosshatched in FIG. 4). As illustrated by curve $T_{surf}$ (solid line) in FIG. 4, the surface temperature of the billet rises to a maximum temperature, $T_{max}$, at the end of time period $T_1$. $T_{max}$ can be close to the melting temperature of the billet material, for example, approximately 750° C. for a billet formed from an aluminum based composition. The choice of this maximum temperature is dependent upon a particular process application, and may be a temperature other than a temperature near the melting temperature of the billet. During time period $T_1$ in the first power cycle, the axial center temperature of the billet rises slowly as the heat induced in the outer depth of current penetration of the billet conducts towards the center. For the remainder of first power cycle, $T_{cycle}$, while coil 1 is not energized and coils 2 through 5 are sequentially supplied current through their respective power switches, the inductively generated heat in billet 11 conducts towards the axial center of the billet in this time period, as indicated by curve $T_{cen}$ (dashed line), as the surface temperature of the billet drops. During the second power cycle, $T_{cycle2}$, current is supplied to coil 1 from power supply 30 through conducting power switch 16*a* for time period $T_2$ (shown crosshatched in FIG. 4), which is shorter than previous applied power time period $T_1$. As illustrated by curve $T_{surf}$ in FIG. 4, the surface temperature of the billet once again is raised to maximum temperature, $T_{max}$, while the axial center temperature of the billet continues to rise as illustrated by curve $T_{cen}$ in this time period. For the remainder of the second power cycle, $T_{cyle2}$ While coil 1 is not energized and coils 2 through 5 are supplied power through their respective switches, the inductively generated heat in billet 11 conducts into the interior of the billet as the surface temperature of the billet drops. This cycling process is repeated for third, fourth and fifth power cycles, $T_{cycle3}$ $T_{cycle4}$ and $T_{cycle5}$, respectively, with progressively shorter time periods, $T_3$, $T_4$, and $T_5$, respectively, of applied power to coil 1, and progressively longer periods of power dwell when coil 1 is not connected to the power supply and the induced billet heat is allowed to conduct ("soak") to the center of billet 11. After the application of power to coil 1 in the fifth power cycle, $T_{cycle5}$ for the time period $T_5$ (showed crosshatched in FIG. 4), billet 11 is fully heated and ready for removal from within coil 1 during the remaining time in fifth power cycle, $T_{cycle5}$. To propagate the sequential billet heating process, a new non-heated billet is inserted into coil 1 before the end of the fifth power cycle, $T_{cycle5}$ after removal of fully heated billet 11. After the application of power in the fifth power cycle, $T_{cycle5}$, the billet's surface temperature decreases, and its axial center temperature increases by heat conduction towards a terminal equilibrium temperature, $T_{eq}$. In practice, the billet will not reach the terminal equilibrium temperature throughout the billet material, but any final temperature gradients will be insignificant relative to the subsequent working of the billet in a manufacturing process such as drawing, die casting or forging. If a new non-heated billet is inserted into coil 1 before the end of the fifth power cycle, $T_{cycle5}$, at the beginning of the sixth applied power cycle, $T_{cycle6}$ (with the repeated sequence of variable time periods in $T_{cycle}$), current is supplied to coil 1 from power supply 30 through closed power switch 16*a* for time period $T_1$ to begin the induced heating process for the new non-heated billet. In this arrangement, one billet is sequentially and fully heated in a billet heat cycle, $T_{billet}$, which, as illustrated in FIG. 4, is equal to the time period of five power cycles. Generalizing this for any number of coils and billets, the time of a billet heat cycle is equal to the number of applied power cycles, which, in turn, is equal to the number of coils (billets) being heated at any given time. In some applications, a fully heated billet may not require heating to the center of the billet.

Figure 5:
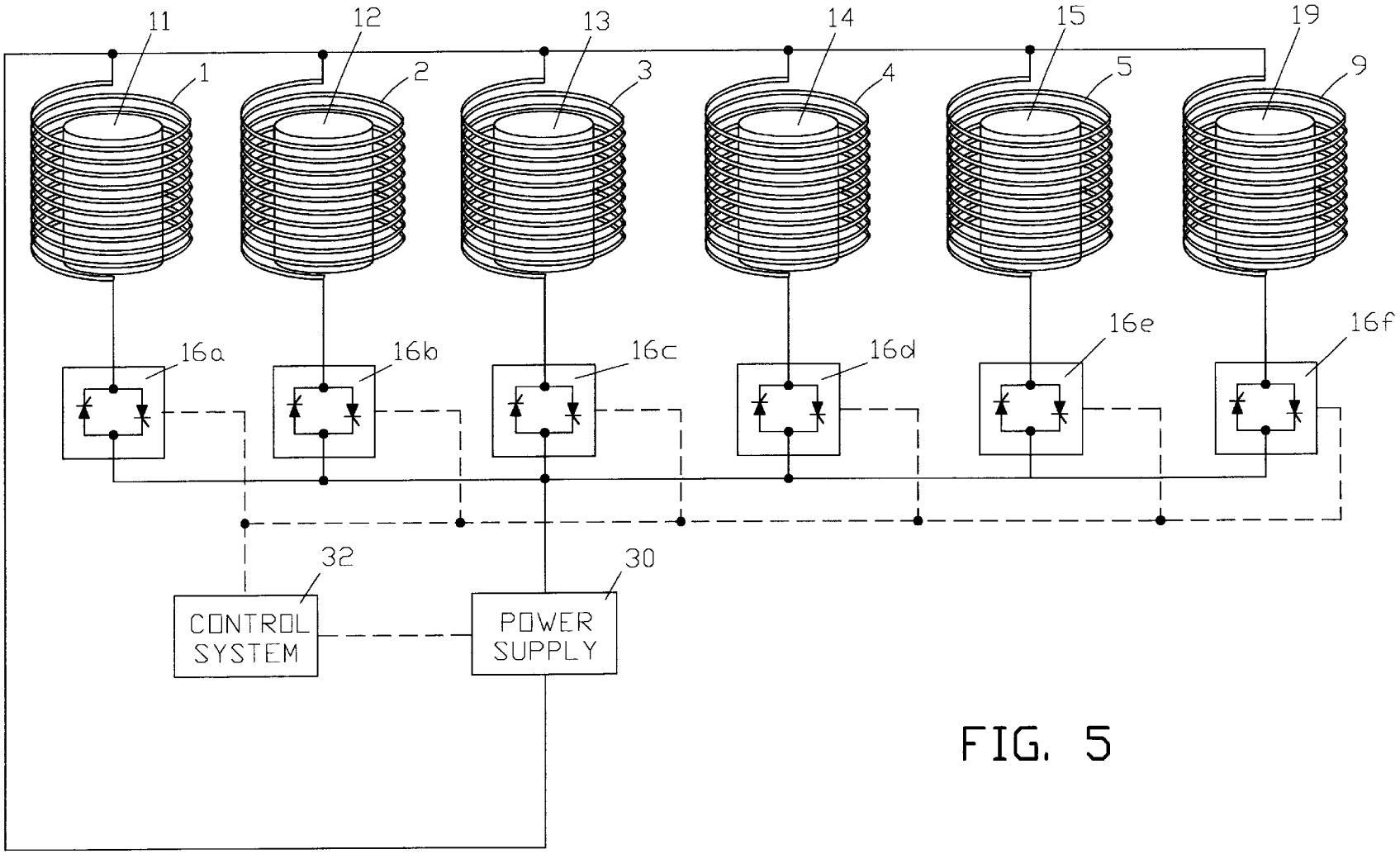
FIG. 5 diagrammatically illustrates another arrangement of the induction billet heating apparatus of the present invention.

Since the billet induction heating process of the present invention is a sequential process of completely induction heating a plurality of billets, the process will have a start up sequence. One method of doing this is not starting the induction heating of the initial billets in the induction coils until the power cycle in which the longest variable time period of connecting the coil to the power source ocurrs. Using the example in FIG. 2, FIG. 3 and FIG. 4, during the first start up power cycle ($T_{cycle1}$) only coil 1 is energized for the indicate $T_1$ time period; during the second start up power cycle ($T_{cycle1}$), only coils 1 and 5 are sequentially energized for time periods $T_2$ and $T_1$, respectively; during the third start up power cycle ($T_{cycle3}$), only coils 1, 4 and 5 are sequentially energized-for time periods $T_3$, $T_1$ and $T_2$, respectively; during the fourth start up power cycle ($T_{cycle4}$ ), only coils 1, 3, 4 and 5 are sequentially energized for time periods $T_4$, $T_1$, $T_2$ and $T_3$, respectively; and during the fifth start up power cycle ($T_{cycle5}$ ), all coils 1, 2, 3, 4 and 5 are sequentially energized for time periods $T_5$, $T_1$, $T_2$, $T_3$ and $T_4$, respectively. After completion of the fifth start up power cycle, billets in coils 1, 2, 3, 4, 5 are sequentially fully induction heated after each successive power cycle. If the output of power supply 30 is such that it cannot remain open circuit during the variable time periods in the start up power cycles when selected coils are not energized (in this example: in first start up power cycle: time period $T_2$ for coil 2, time period $T_3$ for coil 3, time period $T_4$ for coil 4, and time period $T_5$ for coil 5; in second start up power cycle: time period $T_3$ for coil 2, time period $T_4$ for coil 3, and time period $T_5$ for coil 4; in third start up power cycle: time period $T_4$ for coil 2, and time period $T_5$ for coil 3; in fourth start up power cycle: time period $T_4$ for coil 2), the example of the invention illustrated in FIG. 5 may be used. In this example, during the start up power cycles when selected coils are not energized, the output of power supply 30 can be connected to dummy load coil 9 via power switch 16*f* for induction heating of dummy load 19 inserted in the coil.

Control system 32 controls the sequential openings and closings of power switches 16*a* though 16*e* (and 16*f* if used) and the output of power supply 30 to achieve a predetermined schedule for the variable time periods in each power cycle for a particular application of the present invention. In some examples of the invention, the detailed control system disclosed in U.S. Pat. No. 5,523,631, titled Control , System for Powering Plural Inductive Loads from a Single Inverter Source, may be utilized. Numerous design factors are considered for a particular application to determine the applied power and power dwell time periods for each of the multiple power cycles that make up a billet heat cycle. These include the total number of billets (coils) to be heated at the same time; the physical configurations of the coils and billets; and the output of the power supply. Control system 32 may further comprise an input device, such as a keyboard, and an output device, such as a video display, for use by an operator to enter the desired applied power time periods and power dwell time periods.

An advantage of the present invention is that a billet does not have to be moved between coils of varying inductive power output to achieve efficient induction heating. The billet is moved only at the beginning of the heating process for insertion into an induction coil, and at the end of the billet heat cycle for removal from the induction coil. Billet orientation in a coil may range from horizontal to vertical with respect to the axial length of the billet. However when the axial length of the billet is vertically oriented as shown in FIG. 2, there is a tendency for the outer annular regions of the billet to sag under the force of gravity as these regions reach a semi-fluid state when the maximum temperature, $T_{max}$, is close to the melting temperature of the billet material. Thus horizontal orientation of the axial center of the billet is preferred. A non-electrically conductive sleeve can be placed around the billet in any orientation to assist in maintaining the shape of the billet during and after induction heating. In any orientation, a means for inserting a billet into an induction coil prior to the beginning of the multiple power cycles to the coil that make up a billet heat cycle can be provided. Likewise, a means for removing the billet from the induction coil after completion of the heat cycle can be provided. For example, a robotic billet transport system can be provided for automatic sequenced insertion and removal of billets from the induction coils. Movements of the robotic billet transport system can be integrated as input/output interfaces with control system 32 to coordinate robotic removal from an induction coil after the billet has been subjected to the billet heat cycle, and insertion of a new billet in the coil for induction heating.

In some examples of the present invention, a temperature sensor, such as a pyrometer, can be used to dynamically sense the surface temperature of each billet during the billet's heating in an induction coil. These temperature sensors could provide an input temperature signal to control system 32, which would contain a processor, such as a computer microprocessor, to dynamically provide an output signal for adjustment of one or more process parameters. For example, the control system may output a control signal for changing the magnitude of the output power of power supply 30, or the control system may output a control system to change the applied power time periods and power dwell time periods in the power cycles that make up a billet heat cycle.

The examples of the invention include reference to specific electrical components. One skilled in the art may practice the invention by substituting components that are not necessarily of the same type but will create the desired conditions or accomplish the desired results of the invention. For example, single components may be substituted for multiple components or vice versa.

The foregoing examples do not limit the scope of the disclosed invention. The scope of the disclosed invention is further set forth in the appended claims.

What is claimed is:

1. Apparatus for sequentially induction heating a plurality of billets, the apparatus comprising:

a plurality of induction coils, the number of the plurality of induction coils equal to the number of the plurality of billets, each of the plurality of billets inserted into an individual one of the plurality of induction coils, each of the plurality of billets substantially surrounded along its axial length by the individual one of the plurality of induction coils;

an at least one ac power supply providing ac current to each of the plurality of induction coils; and a means for individually connecting each one of the plurality of induction coils sequentially to the at least one ac power supply for a variable time period in each one of a plurality of power cycles, the number of the plurality of power cycles equal to the number of the plurality of induction coils, the variable time period in each successive one of the plurality of power cycles for each one of the plurality of billets being a shorter time period than the time period in the prior power cycle, the variable time periods for connecting each of the plurality of induction coils over the plurality of power cycles being equal in time, and the variable time periods for connecting each of the plurality of induction coils in a power cycle being different for each one of the plurality of induction coils, whereby each of the plurality of billets is sequentially induction heated after completion of the plurality of power cycles for each of the plurality of billets.

2. The apparatus of claim 1 where in the at least one ac power supply has a substantially constant magnitude of output power.

3. The apparatus of claim 1 further comprising: a means for inserting each of the plurality of billets into the individual one of the plurality of induction coils prior to connecting the individual one of the plurality of induction coils to the at least one ac power supply for the one of the plurality of power cycles having the longest variable time period; and a means for removing each of the plurality of billets from each of the plurality of induction coils after the completion of the plurality of the power cycles for each of the plurality of billets.

4. The apparatus of claim 1 further comprising a non-electrically conductive sleeve at least partially surrounding the axial length of each one of the plurality of billets to retain the outer shape of the inductively heated billet.

5. The apparatus of claim 1 further comprising at least one temperature sensor to sense the surface temperature of each one of the plurality of billets.

6. The apparatus of claim 5 further comprising a processor having as an input the at least one temperature sensor, and an output to adjust the time period of the variable time periods in each of the plurality of power cycles.

7. The apparatus of claim 5 further comprising a processor having as an input the at least one temperature sensor, and an output to adjust the magnitude of output power of the at least one ac power supply.

8. A method of sequentially induction heating a plurality of billets, the method comprising the steps of:

substantially surrounding the axial length of each one of the plurality of billets with an individual induction coil, the number of the individual induction coils equal to the number of the plurality of billets; and supplying power from an at least one ac power supply sequentially to each of the induction coils by a switching means for a variable time period in each one of a plurality of power cycles, the number of the plurality of power cycles equal to the number of the individual induction coils, the variable time period in each successive one of the plurality of power cycles for each one of the plurality of billets being a shorter time period than the time period in the prior power cycle, the variable time-periods for connecting each of the plurality of induction coils over the plurality of power cycles being equal in time, and the variable time periods for connecting each of the plurality of induction coils in a power cycle being different for each one of the plurality of induction coils.

9. The method of claim 8 further comprising the step of holding the magnitude of the output power of the at least one ac power supply substantially constant.

10. The method of claim 8 further comprising the step of placing a non-electrically conductive sleeve at least partially around the axial length of each one of the plurality of billets.

11. The method of claim 8 further comprising the step of sensing the surface temperature of each one of the plurality of billets.

12. The method of claim 11 further comprising the step of adjusting the time period of the variable time periods in each of the power cycles responsive to the surface temperature of each one of the plurality of the billets.

13. The method of claim 11 further comprising the step of adjusting the magnitude of the output power of the at least one ac power supply responsive to the surface temperature of each one of the plurality of the billets.

14. The method of claim 8 further comprising the steps of:

inserting each of the plurality of billets into the individual one of the plurality of induction coils prior to connecting the individual one of the plurality of induction coils to the at least one ac power supply for the one of the plurality of power cycles having the longest variable time period; and removing each of the plurality of billets from each of the plurality of induction coils after the completion of the plurality of the power cycles for each of the plurality of billets.

15. A method of sequentially induction heating a plurality of billets, the number of billets equal to a number, n, the method comprising the steps of:

inserting each one of the plurality of billets into an individual induction coil, the individual induction coil substantially surrounding the axial length of the inserted billet, the number of the individual induction coils equal to the number, n;

establishing a number of power cycles for heating each of the plurality of billets, the number of power cycles equal to the number, n;

establishing a number of applied power time periods for applying power from an at least one ac power supply to each of the individual induction coils, the number of applied power time periods equal to the number, n, the n applied power time periods forming a series of decreasing time periods ranging from a maximum time period to a minimum time period value, each of the n applied power time periods in the series of time periods applied consecutively from the maximum tine period to the minimum time period in successive n power cycles to each of the individual induction coils;

first applying power from the at least one ac power supply for the maximum time period uniquely to one of the individual induction coils in each of the n power cycles, removing each one of the plurality of billets from an individual induction coil after applying power from an at least one ac power supply for the minimum time period to provide an unoccupied induction coil; and inserting an unheated billet into the unoccupied induction coil prior to the start of applying power from the at least one ac power supply for the maximum time period to the unoccupied induction coil.

16. The method of claim 15 further comprising the step of holding the magnitude of the output power of the at least one ac power supply substantially constant.

17. The method of claim 15 further comprising the step of placing a non-electrically conductive sleeve at least partially around the axial length of each one of the plurality of billets.

18. The method of claim 15 further comprising the step of sensing the surface temperature of each one of the plurality of billets.

19. The method of claim 18 further comprising the step of adjusting the time period of the variable time periods in each of the power cycles responsive to the surface temperature of each one of the plurality of the billets.

20. The method of claim 18 further comprising the step of adjusting the magnitude of the output power of the at least one ac power supply responsive to the surface temperature of each one of the plurality of the billets.

* * * * *